US005873704A

United States Patent [19]

Ota et al.

[11] Patent Number: 5,873,704

[45] Date of Patent: Feb. 23, 1999

[54] VARIABLE CAPACITY REFRIGERANT COMPRESSOR

[75] Inventors: Masaki Ota; Hisakazu Kobayashi; Masaru Hamasaki; Youichi Okadome, all of Kariya, Japan

[73] Assignee: Kabushiki Kaisha Toyoda Jidoshokki Seisakusho, Kariya, Japan

[21] Appl. No.: 802,659

[22] Filed: Feb. 19, 1997

[30] Foreign Application Priority Data

Feb. 20, 1996 [JP] Japan ..... 8-031863

[51] Int. Cl.[6] ..... F04B 1/26

[52] U.S. Cl. ..... 417/222.2; 417/270; 417/295

[58] Field of Search ..... 417/222.2, 269, 417/270, 295

[56] References Cited

U.S. PATENT DOCUMENTS

| | | | |
|---|---|---|---|
| 4,586,874 | 5/1986 | Hiraga et al. | 417/222.2 |
| 4,664,604 | 5/1987 | Terauchi | 417/222.2 |
| 4,669,272 | 6/1987 | Kawai et al. | 417/270 |
| 4,973,229 | 11/1990 | Oono et al. . | |
| 5,567,124 | 10/1996 | Takenaka et al. | 417/222.2 |
| 5,573,379 | 11/1996 | Kimura et al. | 417/222.2 |

FOREIGN PATENT DOCUMENTS

| | | |
|---|---|---|
| 711918 | 9/1995 | European Pat. Off. . |
| 62-674 | 1/1987 | Japan . |
| 62-276279 | 12/1987 | Japan . |

*Primary Examiner*—Charles G. Freay
*Attorney, Agent, or Firm*—Burgess, Ryan & Wayne

[57] ABSTRACT

A variable-capacity swash-plate operated single-headed piston type compressor including a crank chamber having a capacity large enough for receiving a drive shaft, a rotor, a swash plate and shoes engaging between the swash plate and single headed pistons and provided with an open mouth for directly receiving a refrigerant gas returning from an external refrigerating system, a suction passageway for providing a fluid communication between the crank chamber and a suction chamber from which the refrigerant gas is sucked into respective cylinder bores so as to be compressed by the single headed pistons, and a capacity control valve provided with a bellows element for adjustably changing the cross sectional area of the suction passageway in response to a change in a pressure prevailing in the suction passageway.

11 Claims, 2 Drawing Sheets

VARIABLE CAPACITY REFRIGERANT COMPRESSOR

BACKGROUND OF THE INVENTION

1. Field of the Invention

The present invention relates to a variable capacity refrigerant compressor used for compressing a refrigerant gas in a refrigerating system. More specifically, the present invention relates to a single headed piston type compressor incorporating therein a simple capacity control valve and an improved internal structure for reducing vibratory noise caused by the suction of a refrigerant gas from an external refrigerating system.

2. Description of the Related Art

In variable capacity single-action refrigerant compressors such as variable capacity swash-plate and wobble-plate type compressors used in automobile climate control systems, a rotatable swash plate element or a non-rotatable wobble plate element is supported around a rotating drive shaft as an actuator for actuating reciprocatory motion of single-headed pistons compressing a refrigerant gas within the corresponding cylinder bores. The swash or wobble plate element is held to be turnable about a fulcrum so as to change an angle of inclination thereof with respect to a plane perpendicular to an axis of rotation of the drive shaft. The swash plate or wobble plate element converts the rotation of the drive shaft to a reciprocating movement of respective single headed pistons within the cylinder bores of a cylinder block of the compressor. The swash or wobble plate element is housed in a crank chamber defined by a front chamber arranged in front of the cylinder block, and the angle of inclination of the swash or the wobble plate element is adjustably changed in response to a change in a pressure level prevailing in the crank chamber and acting on respective backs of the single headed pistons which have front acting ends thereof subjecting to a pressure of the refrigerant gas, i.e., a suction pressure when the gas is sucked into the compressor. Since the extent of reciprocation of the single headed pistons, i.e., the stroke of the respective pistons changes so that the back pressure acting on the backs of the pistons and the suction pressure acting on the front acting ends thereof are balanced with one another. Thus, the swash plate or wobble plate element changes its angle of inclination so as to permit the respective pistons to reciprocate at the changed stroke thereof. The pressure prevailing in the crank chamber is controlled by a capacity control valve which is arranged and operates so as to introduce a high pressure discharge gas into the crank chamber in response to a change in the suction pressure.

Nevertheless, the conventional variable capacity single headed piston-type compressor having the capacity control valve must be constructed in such a manner that the crank chamber is always hermetically sealed so as to permit precise control of the pressure prevailing in the crank chamber. Further, the crank chamber is subjected to a high pressure and a high temperature condition provided by a blow-by gas leaking from the respective cylinder bores into the crank chamber during the operation of the compressor. Specifically, when the compressor operates at a full capacity operation under a large refrigerating load, the crank chamber must be subjected to the maximum pressure and very high temperature conditions. Therefore, a shaft sealing device such as a lip seal disposed around the drive shaft of the compressor easily and quickly loses its sealing performance, and moreover, various movable internal elements of compressors such as the pistons, the swash or wobble plate element, and shoes arranged between the swash or wobble plate element and the respective pistons are abraded to result in a reduction in the operation life of the compressor. In this connection, sometimes, either a high quality hard metallic material is selected to produce a swash or wobble plate element or a particular surface treatment for preventing abrasion is applied to the surface of the swash or wobble plate element. Nevertheless, the selection of the metallic material and the application of the particular surface treatment must result in an increase in the production cost of the swash or wobble plate element.

Further, the variable capacity type refrigerant compressor usually has a large pulsation in the suction pressure of the refrigerant gas during the small capacity compressing operation of the compressor, and accordingly, a pulsative noise is caused in an evaporator disposed in a refrigerating system in which the compressor is incorporated. Thus, there is a case in which a variable capacity refrigerant compressor is provided therein with a muffling means for deadening the pulsation in the suction pressure of the refrigerant gas. The provision of the muffling means becomes a cause of an increase in the manufacturing cost of the compressor. Furthermore, the afore-mentioned capacity control valve supplying a discharge pressure gas into the crank chamber of the compressor in response to a change in the suction pressure of the refrigerant gas has a complicated internal structure therein, and must be assembled in the body of the compressor so as to adequately cooperate with fluid passageways arranged in the body of the compressor in order to detect the suction pressure and the pressure prevailing in the crank chamber and a fluid supply passageway running from the discharge chamber to the crank chamber. Therefore, an increase in the manufacturing cost is caused by the provision and assembly of the capacity control valve and by complexity in the formation of the fluid passageways in the body of the compressor.

SUMMARY OF THE INVENTION

An object of the present invention is to eliminate the afore-mentioned problems encountered by the conventional variable capacity swash and wobble plate type refrigerant compressors.

Another object of the present invention is to provide a variable capacity swash-plate-operated single-headed piston type refrigerant compressor accommodating therein an improved internal construction to sufficiently reduce pulsations in the suction pressure to thereby reduce the pulsative noise occurring in an evaporator of a refrigerating system in which the compressor is incorporated.

A further object of the present invention is to provide a variable capacity swash-plate-operated single-headed piston type refrigerant compressor having a novel crank chamber contrived so as not only to solve the problem of pulsative noise but also to increase an operating life of respective internal movable elements of the compressor to thereby enhance the reliability of the compressor.

A further object of the present invention is to provide a variable capacity swash-plate-operated single-headed piston type refrigerant compressor provided with, in addition to the above-mentioned novel crank chamber, a simplified capacity control valve incorporated in the compressor to adequately control the compression or delivery capacity of the compressor.

In accordance with the present invention, there is provided a variable capacity single-headed piston-type refrigerant compressor comprising a cylinder block provided with a plurality of parallel cylinder bores formed therein and having front and rear ends, a front housing arranged to be in sealing contact with the front end of the cylinder block to define a crank chamber therein, a rotatable drive shaft supported by the front housing and the cylinder block and having an axis of rotation thereof, a rear housing arranged to be sealing contact with the rear end of the cylinder block to define a suction chamber for a refrigerant gas before compression and a discharge chamber for the refrigerant gas in compressed state, a swash plate element mounted around the drive shaft to be rotatable with the drive shaft and to be turnable to change an angle of inclination thereof with respect to a plane perpendicular to the axis of rotation of the drive shaft, and a plurality of single-headed pistons operatively connected to the swash plate element and reciprocating in the respective cylinder bores in response to the rotation of the swash plate element, wherein the crank chamber is formed to have a predetermined space sufficient for permitting the swash-plate element to rotate and turn therein during the operation of the compressor and has an open mouth for providing fluid communication between the crank chamber and a refrigerant gas return passageway of an external refrigerating system, the crank chamber being further fluidly communicated with the suction chamber by a suction passageway means in which a capacity control valve element is arranged so as to control a cross-sectional area of a part of the suction passageway means in response to a change in a pressure of the refrigerant gas flowing through the suction passageway means from the crank chamber to the suction chamber, the capacity control valve changing a pressure level prevailing in the crank chamber to thereby adjustably cause a change in the angle of inclination of the swash plate element.

When the variable capacity single-headed piston-type refrigerant compressor is incorporated in the external refrigerating system for compressing the refrigerant gas, the gas returning from the external refrigerating system through the refrigerant gas return passageway is received by the crank chamber via the open mouth. The suction refrigerant gas is further introduced into the suction chamber through the suction passageway means, and is sucked into each of the plurality of cylinder bores via a respective suction valve so as to be compressed by the plurality of single headed pistons within the cylinder bores. The refrigerant gas in the compressed state is discharged from the cylinder bores into the discharge chamber via respective discharge valves. Thus, the crank chamber of the compressor is constantly filled with the suction refrigerant gas having a low suction pressure. Since the suction refrigerant gas returning from the external refrigerating system into the crank chamber has a low temperature and contains therein a lubricating oil mist component, the crank chamber and various internal moving elements of the compressor such as swash plate element, shoes and bearings can be cooled and lubricated Thus, the mechanical durability of the internal moving elements is greatly increased. Further, a lip seal type shaft seal device arranged for sealing the circumference of the drive shaft at a boundary position between the crank chamber and the outer atmosphere is not subjected to a high pressure as exerted by the refrigerant gas in the compressed state, and accordingly, is not subjected to considerable frictional heat during the rotation of the drive shaft. Thus, the shaft seal device is not degraded for an appreciably long operation time of the compressor.

When the capacity of the compressor is to be reduced in response to a reduction in a refrigerating load of the external refrigerating system, the capacity control valve acts so as to reduce the cross sectional area of the part of the suction passageway means in direct response to a change in pressure in the suction passageway means. Accordingly, a pressure prevailing in the suction chamber is lowered to reduce the pressure acting on respective front ends of the plurality of single headed pistons. Thus, the strokes of the respective single headed pistons are reduced under the influence of a pressure prevailing in the crank chamber and acting on the back ends of the respective single headed pistons. As a result, the swash plate element is turned around the fulcrum thereof to reduce the angle of inclination thereof to thereby reduce the capacity of the compressor. The crank chamber defined by the front housing and having the predetermined space can operate as a muffling chamber to suppress pulsation in the suction pressure of the refrigerant gas.

Preferably, the capacity control valve is provided with a bellows element for defining a pressure sensitive chamber fluidly communicating with the suction passageway means and an atmospheric pressure chamber isolated from the pressure sensitive chamber and constantly communicated with the atmosphere, the bellows element being movable to a position reducing the cross section area of the part of the suction passageway means, and a spring element arranged within the atmospheric pressure chamber to constantly urge the bellows element toward the pressure sensitive chamber. Thus, the bellows element is moved to a position where a combination of the atmospheric pressure and the spring force of the spring element is balanced with the pressure prevailing in the suction passageway means, and the movement of the bellows element causes a change in the cross sectional area in the suction passageway means to thereby control the pressure prevailing in the suction chamber.

The pressure sensitive chamber of the capacity control valve is preferably defined in the rear housing so as to form a portion of the suction passageway means.

The swash plate element may preferably include a combination of a rotatable swash-plate and a plurality of pairs of shoes arranged between the periphery of the swash plate and the plurality of single-headed pistons.

Alternately, the swash-plate element may be a combination of a rotatable swash plate and a non-rotatable wobble-plate connected to the plurality of single-headed pistons via a plurality of connecting rods.

BRIEF DESCRIPTION OF THE DRAWINGS

The above and other objects, features and advantages of the present invention will be made more apparent from the ensuing description of a preferred embodiment thereof with reference to the accompanying drawings wherein.

DESCRIPTION OF THE PREFERRED EMBODIMENT

Figure 1:
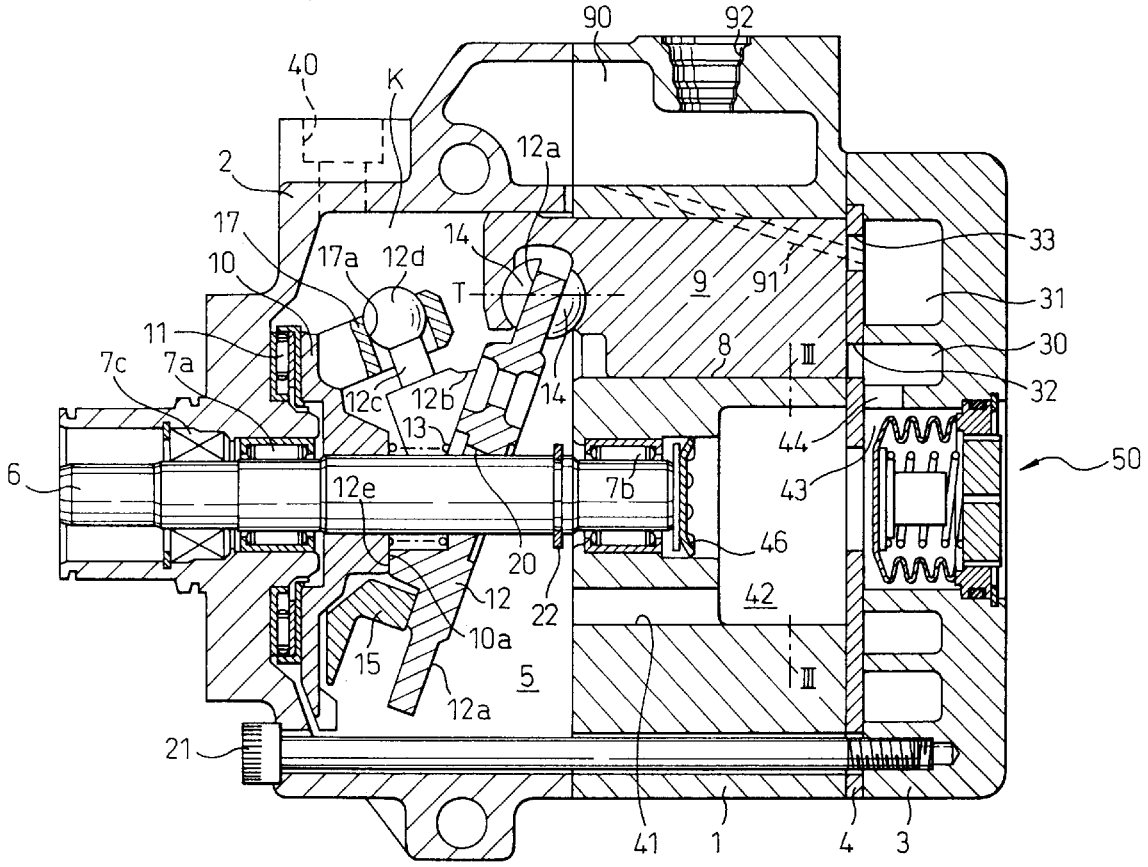
FIG. 1 is a longitudinal cross sectional view of a variable capacity swash plate operated single headed piston type compressor according to an embodiment of the present invention.
Figure 2:
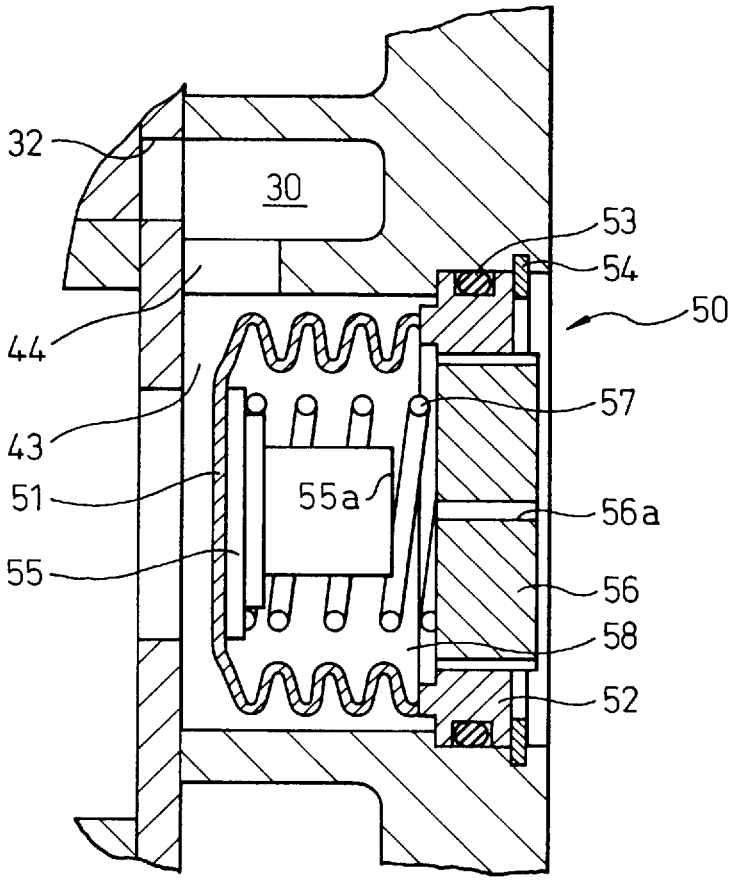
FIG. 2 is a partial enlarged cross sectional view of a capacity control valve incorporated in the compressor of FIG. 1.
Figure 3:
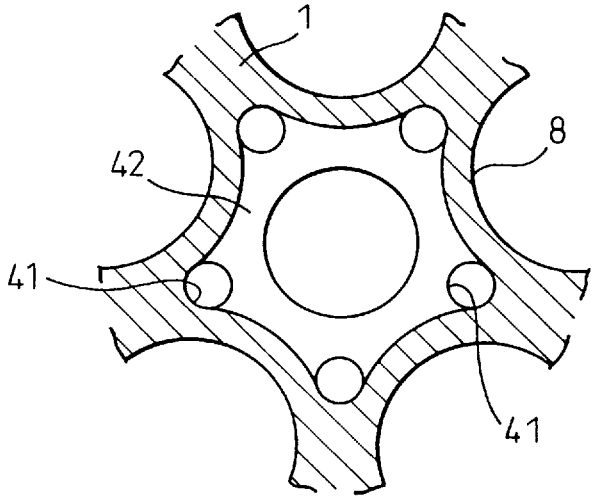
FIG. 3 is a partial cross sectional view taken along the line III—III of FIG. 1, illustrating suction passageways arranged in the compressor of FIG. 1.

Referring to FIGS. 1 through 3, a variable-capacity swash-plate-operated single-headed refrigerant compressor includes a cylinder block 1 having axially spaced front and rear ends. The front end of the cylinder block 1 is sealingly closed by a front housing 2, and the rear end of the cylinder block 1 is sealingly closed by a rear housing 3 via a valve plate 4. The front housing 2, the cylinder block 1 and the rear housing 3 are tightly combined together by a plurality of long screw bolts 21 (only one of the screw bolts is shown in FIG. 1). The front housing 2 defines a crank chamber 5 therein so as to be arranged in front of the front end of the cylinder block 1, and an axial drive shaft 6 is arranged so as to extend axially within the crank chamber 6. The drive shaft 6 is rotatably supported by the front housing 2 and the cylinder block 1 via front and rear anti-friction bearings 7*a* and 7*b*, and has a front end extending through a front portion of the front housing 2 toward the outside of the front housing 2. Thus, the drive shaft 6 can be connected to a rotative drive source, e.g., an automobile engine, via a solenoid clutch (not shown in FIG. 1), and a suitable rotation transmitting unit. The drive shaft 6 has an axis of rotation about which the drive shaft 6 rotates when it is driven by the rotative drive source. The front portion of the drive shaft 6 is sealed by a shaft sealing device 7*c* arranged in the front portion of the front housing 2 at a position adjacent to the front bearing 7*a*. Namely, the shaft sealing device 7*c* seals the circumference of the drive shaft 6 so that the crank chamber 5 is completely isolated from the outside of the compressor.

The cylinder block 1 is provided with a plurality of circumferentially spaced cylinder bores 8 arranged around the axis of rotation of the drive shaft 6, so that a plurality of single-headed pistons 9 are slidably fitted in the respective cylinder bores 8.

Within the crank chamber 5, a rotor 10 is mounted on the drive shaft 6 at a position adjacent to an inner wall of the front housing 2 so as to be rotated with the drive shaft 6. The rotor 10 is axially supported by a thrust bearing 11 seated on the inner wall of the front housing 2. The rotor 10 is provided with a later-described support arm portion 17 formed to project rearwardly.

A swash plate 12 is arranged around the drive shaft 6 in a manner such that the drive shaft 6 extends through a non-linear through-bore 20 formed in a substantially central portion of the swash plate 12. The swash-plate 12 is constantly and rearwardly urged by a coil spring 13 arranged between the rotor 10 and the swash plate 12. The swash plate 12 is also provided with sliding surfaces 12*a* formed in opposite faces thereof at an outer peripheral portions of both surfaces. The sliding surfaces 12*a* in the form of annularly extending face portions are slidably sandwiched by a plurality of pairs of semi-spherical shoes 14 which are slidably engaged in respective single-headed pistons 9. Thus, the swash plate 12 is operatively engaged with the respective pistons 9.

The swash plate 12 is further provided with a pair of brackets 12*b*, 12*b* formed on a front side thereof so as to project from a radially inner portion of the front surface toward the rotor 10. The pair of brackets 12*b*, 12*b* are circumferentially arranged at substantially symmetrical positions with respect to the top dead-center position "T" of the swash plate 12, and support thereon a pair of guide pins 12*c*, 12*c* having respective balls 12*d*, 12*d* at the ends of the guide pins 12*c*, 12*c*. The guide balls 12*d*, 12*d* of the guide pins 12*c*, 12*c* of the swash plate 12 are movably fitted in a pair of guide holes 17*a*, 17*a* of the support arm 17 of the rotor 10 so as to form a part of a hinge unit "K" engaging between the rotor 10 and the swash plate 12.

The afore-mentioned non-linear through-bore 20 of the swash plate 12 permits the latter plate 12 to turn about an axis perpendicular to the axis of rotation of the drive shaft 6 in order to change its angle of inclination.

A counter weight 15 is rivetted to the swash plate 12 at a position corresponding to the bottom dead center position of the swash plate 12 on the front side. The counter weight 15 has a shape of a block confronting the rotor 10 and having a portion radially projecting with respect to the axis of rotation of the drive shaft 6. The counter weight 15 is arranged so as to avoid mechanical interference with all the shoes 14 of the respective pistons 9 during the rotation of the swash plate 12.

The swash plate 12 has a front stop end 12*e* formed in a portion thereof radially inner region than the counter weight 15. The front stop end 12*e* of the swash plate 12 is provided for being engaged with a rear stop end face 10*a* of the rotor 10 when the swash plate 12 turns to its maximum angle of inclination. Namely, the engagement of the front stop end 12*e* with the rear stop end face 10*a* determines the maximum angle of inclination of the swash plate 12. On the other hand, the minimum angle of inclination of the swash plate 12 is determined by an engagement of a centrally arranged counterbore portion of the swash plate 12 with a circlip 22 fixedly mounted on a rear portion of the drive shaft 6. It should be noted that the minimum angle of inclination of the swash plate 12 is not zero but is close to a zero angle of inclination position with respect to the plane perpendicular to the axis of rotation of the drive shaft 6.

The guide holes 17*a*, 17*a* of the support arm 17 of the hinge unit "K" which receive therein the guide balls 12*d*, 12*d* are arranged to extend in parallel with a plane defined by the top dead center "T" of the swash plate 12 and the axis of rotation of the drive shaft 6, and bored so as to radially inwardly approach the axis of rotation of the drive shaft 6. Further, the guide holes 17*a*, 17*a* of the support arm 17 of the hinge unit "K" are designed so as to permit the guide balls 12*d*, 12*d* to slide therein while allowing each of the single headed pistons 9 to slide in the corresponding cylinder bore 8 to a constant top dead center position thereof irrespective of a change in the angle of inclination of the swash plate 12 during the operation of the compressor.

In accordance with the present invention, the crank chamber 5 is provided with an open mouth 40 for receiving a refrigerant gas to be compressed when it returns from an external refrigerating system. Thus, the open mouth 40 formed in a portion of the front housing 2 acts as a suction inlet of the compressor which is connectable to an external suction conduit of the refrigerating system. Since the crank chamber 5 directly receiving the returning refrigerant gas has a predetermined space large enough to permit the swash plate 12 to rotate and turn therewithin, the chamber 5 per se can act as a suction muffling chamber to absorb or suppress pulsations in the suction pressure of the refrigerant gas before compression. The crank chamber 5 is fluidly communicated with a suction chamber 30 through a suction passageway means formed in the body of the compressor. The suction passageway means includes a plurality of axial fluid passages 41 formed in the cylinder block 1 and arranged between respective two neighboring cylinder bores 8 as best shown in FIG. 3. The suction passageway means further includes a large chamber 42 formed in a central portion of the cylinder block 1 to have the shape of a substantially pentagonal chamber recessed from the rear end of the cylinder block 1, and directly connected to the respective axial fluid passages 41. The suction passageway means still further includes a valve chamber 43 formed in the central portion of the rear housing 3 so as to be communicated with the large chamber 42 of the cylinder block 1 via a central bore formed in the valve plate 4, and a plurality of valve bores 44 formed in the wall of the valve chamber 43 so as to provide a fluid communication between the valve chamber 43 and the suction chamber 30. It should be noted that the valve chamber 43 formed in the rear housing 3 also acts as a pressure sensitive chamber of a later-described capacity control valve 50.

The rear housing 3 having the suction chamber 30 and the valve chamber 43 further has a discharge chamber 31 for receiving the refrigerant gas in the compressed state. The discharge chamber 31 is arranged radially outside the suction chamber 30 and isolated from the latter chamber 30.

The suction chamber 30 is fluidly communicated with respective cylinder bores 8 via corresponding suction ports 32 formed in the valve plate 4.

The discharge chamber 31 is fluidly communicated with respective cylinder bores 8 via corresponding discharge ports 33 formed in the valve plate 4.

The suction and discharge ports 32 and 33 are covered by suction and discharge valves (not shown in FIGS. 1 through 3) which are opened and closed in response to the reciprocation of the single headed pistons 9 within the cylinder bores 8 of which respective regions formed between the valve plate 4 and the front ends of the single headed pistons 9 act as compression chambers for compressing the refrigerant gas.

The discharge chamber 31 of the rear housing 3 is connected to a pulsation muffling chamber 90 for suppressing pulsations in the pressure of the compressed refrigerant gas, via a discharge passage 91. The pulsation muffling chamber 90 for the compressed refrigerant gas is formed in an outer frame portion of the cylinder block 1 and in an outer portion of the front housing 2, and is provided with a delivery outlet 92 which is connectable to a hose joint of a delivery conduit (not shown) of the external refrigerating system.

The afore-mentioned valve chamber 43 of the rear housing 3 receives a capacity control valve 50 which operates so as to control fluid communication between the large chamber 42 of the suction passageway means and the suction chamber 30 in response to a change in a pressure prevailing in the suction passageway means. Namely, as best shown in FIG. 2, the capacity control valve 50 includes a bellows element 51 received in the central region of the valve chamber 43 and having an open end attached to a base mounting ring 52 sealingly fitted in an outer open end of the valve chamber 43 via an annular seal 53 and a clipping ring 54 seated in the outer open end of the valve chamber 43. A region of the valve chamber 43 surrounding the bellows element 51 forms a pressure sensitive chamber defined within the suction passageway means. The bellows element 51 of the capacity control valve 50 moves so as to adjustably change a cross sectional area of the suction passageway means at a position adjacent to the plurality of valve bores 44 and the central bore of the valve plate 4. The bellows element 51 has a spring seat 55 attached to an inner face of the bellows element 51 within an interior of the bellows element 51, and the spring seat has a cylindrical projection 55*a*.

The capacity control valve also has a seat plate 56 threadedly engaged with an inner threaded bore of the base mounting ring 52 at a position confronting an end of the cylindrical projection 55*a* of the spring seat 55. A coil spring 57 is arranged between the spring seat 55 and the seat plate 56 so as to apply an adjusted spring force urging the bellows element 51 toward an extended position thereof. The seat plate 56 has a central hole 56*a* for providing a constant fluid communication between the interior of the bellows element 51 and the atmosphere, so that the interior of the bellows element 51 is formed as an atmospheric pressure chamber 58 constantly maintained at the atmospheric pressure. The bellows element 51 can be moved against the spring force of the coil spring 57 from its extended position reducing the cross sectional area of the suction passageway means to a compressed position extending the cross sectional area of the suction passageway means. The compressed position of the bellows element 51 is determined by the cylindrical projection 55*a* which abuts against an inner face of the seat plate 56. The spring force of the coil spring 57 of the capacity control valve 50 can be adjusted by threadedly moving the seat plate 56 with respect to the base mounting ring 52.

The above-described variable capacity swash-plate operated single-headed piston type refrigerant compressor according to the embodiment of the present invention can operate as described below.

When the compressor is stopped, the pressure prevailing in the interior of the body of the compressor is kept at a predetermined high level. Thus, the pressure in the pressure sensitive chamber 43 of the capacity control valve 50 is set at a level higher than the sum of the atmospheric pressure and the spring force of the coil spring 57. Therefore, the bellows element 51 of the capacity control valve 50 is moved to its compressed position extending the cross sectional area of the valve holes 44 of the suction passageway means.

When the drive shaft 6 of the compressor is rotatively driven by the external drive source via the solenoid clutch, the rotation of the drive shaft 6 causes the rotation of the swash plate 12 via the rotor 10 and the hinge unit "K". Thus, the swash plate 12 having an angle of inclination thereof implements a nutating motion to cause reciprocation of the respective single headed pistons 9 within the corresponding cylinder bores 8. Therefore, suction of the refrigerant gas, compression of the refrigerant gas, and discharge of the compressed refrigerant gas takes place. At the initial stage of the operation of the compressor, an objective area to be refrigerated by the refrigerating system is normally kept at a high temperature, and the pressure of the refrigerant gas returning from the external refrigerating system into the crank chamber 5 of the compressor is maintained at a high level. Accordingly, the pressure prevailing in the crank chamber 5 sufficiently communicated with the suction chamber 30 via the suction passageway means having an extended cross sectional area has an appreciably small differential with respect to a suction pressure prevailing in the suction chamber 30. Therefore, the respective pistons 9 reciprocate within the corresponding cylinder bores 8 at the maximum stroke thereof. Namely, a full capacity operation of the compressor is performed. That is to say, the refrigerant gas returning from the refrigerating system is received by the crank chamber 5 via the open mouth 40, and smoothly flows toward the suction chamber 30 via the suction passageway means including the axial passages 41, the large chamber 42, the valve chamber 43, and the valve holes 44. Then, the refrigerant gas is sucked into the respective cylinder bores 8 through the suction ports 32 of the valve plate 4. Thus, the crank chamber 5 is filled with the refrigerant gas immediately after returning from the external refrigerating system, i.e., the refrigerant gas having a reduced pressure substantially equal to a pressure prevailing in the suction chamber 30 and a low temperature, and containing therein lubricating particles. Therefore, the entire region of the crank chamber 5 is maintained at a suction pressure atmosphere, and is cooled and lubricated by the refrigerant gas. Consequently, the internal moving elements of the compressor such as the swash plate 12, the hinge unit "K", the shoes 14, the pistons 9, the anti-friction bearings 7*a*,7*b*, the thrust bearings, and the outer circumference of the drive shaft 6 can be maintained in a sufficiently cooled and lubricated condition. Thus, the mechanical durability of the internal moving elements of the compressor can be remarkably enhanced. Further, since the shaft sealing device 7*c* is constantly exposed to a relatively low pressure condition of the crank chamber 5 compared with the conventional compressor, the shaft sealing device 7*c* is not frictionally abraded, and therefore, the sealing performance of the shaft sealing device 7*c* can be prevented from being thermally deteriorated or damaged.

The refrigerant gas sucked into the respective cylinder bores 8 is compressed by the respective single headed pistons 9 within the compression chamber, and is discharged therefrom into the discharge chamber 31 via the discharge ports 33 of the valve plate 4 when the discharge valves are opened. The compressed refrigerant gas in the discharge chamber 31, in turn, flows into the muffling chamber 90 through the discharge passage 91. When the compressed refrigerant gas enters the muffling chamber 90, pulsations in the high discharge pressure of the compressed refrigerant gas are damped within the large muffling chamber 90. Subsequently, the compressed refrigerant gas is delivered from the muffling chamber 90 to the external refrigerating system via the delivery outlet 92. Since the damping of pulsations in the discharge pressure of the compressed refrigerant gas within the muffling chamber 90 causes separation of lubricating oil particles from the compressed refrigerant gas, the lubricating oil is collected in the bottom of the muffling chamber 90 and in turn returns into the crank chamber 5.

During the full capacity operation of the compressor, an objective cooled region such as a passenger cabin of an automobile is gradually cooled so as to lower the temperature therein. Accordingly, the delivery capacity of the compressed refrigerant gas is gradually reduced due to a reduction in a refrigerating load applied to the compressor. Therefore, the pressure prevailing in the crank chamber 5 as well as the valve chamber or the pressure sensitive chamber 43 becomes lower than the combination of the atmospheric pressure and the spring force of the coil spring 57 of the capacity control valve 50 to resultingly cause an extending motion of the bellows element 51 of the capacity control valve 50. Accordingly, the cross sectional area of the suction passageway means running from the crank chamber 5 to the suction chamber 30 is reduced at a position adjacent to the valve holes 44 and the central bore of the valve plate 4 (see FIG. 2). Thus, an amount of flow of the refrigerant gas from the crank chamber 5 into the suction chamber 30 is reduced so as to cause a reduction in the suction pressure prevailing in the suction chamber 30, and therefore, an appreciable pressure differential appears between the suction pressure and the pressure prevailing in the crank chamber 5. Consequently, the strokes of the respective pistons 9 and the angle of inclination of the swash plate 12 decrease so that a low capacity operation of the compressor is performed. Then, the compressor continues the low capacity operation until a refrigerating load applied to the compressor changes. Namely, the capacity of the compressor is continuously controlled by the capacity control valve 50 which controls the cross sectional area of the suction passageway means within the compressor in response to a change in the refrigerating load.

It should be noted that the capacity control valve 50 has a simple construction having only a few primary elements thereof, i.e., the bellows element 51 and a coil spring 57 exhibiting an adjustable spring force for urging the bellows element 51 to an extended position thereof. The bellows element 51 in association with the spring 57 can perform multiple functions including directly sensing a change in the pressure of the refrigerant gas returning from the external refrigerating system, causing a change in the suction pressure of the refrigerant gas to thereby generate a pressure differential between the suction pressure and a pressure prevailing in the crank chamber 5 to thereby adjustably change an angle of inclination of the swash plate 12 as well as a stroke of the respective single headed pistons 9, and eventually controlling the capacity of the compressor in response to a change in a refrigerating load applied to the compressor. Further, since the capacity control valve 50 can reduce the cross sectional area of the suction passageway means and restore an initial extended cross sectional area of the suction passageway means in a continuous manner, the controlling of the capacity of the compressor can be very smooth. Therefore, when the compressor is incorporated in an automobile climate control system, the operation of the compressor does not provide any adverse influence on the operation of the automobile engine and the running condition of the automobile.

In the described embodiment, the interior of the bellows element 51 of the capacity control valve 50 is maintained at the atmospheric pressure. However, it is possible to stably maintain the interior of the bellows element 51 at a constant vacuumed pressure condition by employing a vacuum pump.

Alternately, as required, the interior of the bellows element 52 of the capacity control valve 50 may positively be vacuumed in response to various external control signals to forcibly cause an increase in the capacity of the compressor irrespective of a change in the pressure level in the pressure sensitive chamber 43 of the capacity control valve 50. For example, the interior of the bellows element 51 of the capacity control valve 50 may be connected to an air intake side of an automobile engine by means of an appropriate conduit, and a solenoid valve can be arranged in the conduit having a normal position in which the solenoid valve provides a fluid communication between the interior of the bellows element 51 with the atmosphere. The solenoid valve is switched to its shifted position in which the solenoid valve provides a fluid communication between the interior of the bellows element 51 with the air intake side of the engine in response to control signals such as signals indicating temperature in the passenger cabin, amount of sunlight falling on the automobile, and the driver's performance.

From the foregoing description of the embodiment of the present invention, it will be understood that according to the present invention, the variable capacity refrigerant compressor having a crank chamber subjected to a suction pressure atmosphere can be effective for reducing pulsations in the suction pressure of the refrigerant gas. Thus, the compressor can sufficiently reduce pulsative noise occurring in an external refrigerating system.

Further, the crank chamber of the variable capacity refrigerant compressor according to the present invention can be effectively cooled and lubricated by the refrigerant gas returning from the external refrigerating system. Thus, the internal moving elements of the compressor can be constantly cooled and lubricated so as to enhance the operation durability of the compressor. Particularly, since the shaft sealing device arranged at an outer portion of the drive shaft does not need to seal the circumference of the drive shaft against a high pressure, the shaft sealing device cannot be thermally damaged by abrasion.

Further, since the capacity control valve is constructed by a small number of elements in a simple manner, the control valve can be a low cost element resulting in a reduction in the manufacturing cost of the variable capacity refrigerant compressor.

What we claim:

1. A variable capacity single headed piston type refrigerant compressor comprising:

a cylinder block provided with a plurality of parallel cylinder bores formed therein and having front and rear ends;

a front housing arranged to be in sealing contact with said front end of said cylinder block to define a crank chamber therein;

a rotatable drive shaft supported by said front housing and said cylinder block and having an axis of rotation thereof;

a rear housing arranged to be in sealing contact with said rear end of said cylinder block to define a suction chamber for a refrigerant gas before compression and a discharge chamber for the refrigerant gas in a compressed state;

a swash plate element mounted around said drive shaft to be rotatable with said drive shaft and to be turnable to change an angle of inclination thereof with respect to a plane perpendicular to the axis of rotation of said drive shaft; and a plurality of single headed pistons operatively connected to said swash plate element and reciprocating in said respective cylinder bores in response to the rotation of said swash plate element, wherein said crank chamber is formed to have a predetermined space sufficient for permitting said swash plate element to rotate and turn therein during the operation of said compressor and has an open mouth for providing fluid communication between said crank chamber and a refrigerant gas return passageway of an external refrigerating system, said crank chamber being further fluidly communicated by a suction passageway means with said suction chamber, and wherein a capacity control valve element is arranged in said suction passageway means so as to control a cross-sectional area of a part of said suction passageway means in response to a change in a pressure of the refrigerant gas flowing through said suction passageway means from said crank chamber to said suction chamber, said capacity control valve changing a pressure level prevailing in said crank chamber to thereby adjustably cause a change in the angle of inclination of said swash plate element.

2. A variable capacity single headed piston type refrigerant compressor according to claim 1, wherein said open mouth of said crank chamber is formed in a part of said front housing at a position suitable for being connected to an external refrigerating system in which said compressor is incorporated.

3. A variable capacity single headed piston type refrigerant compressor according to claim 1, wherein said suction passageway means comprises a plurality of axial suction passageways formed in said cylinder block at positions radially inside said cylinder bores, an enlarged chamber communicated with all of said plurality of axial suction passageways, and a centrally arranged chamber formed in said rear housing and enclosed by a wall in which at least one valve hole is formed to provide a fluid communication between said centrally arranged chamber and said suction chamber, and at least a through-hole formed between said enlarged chamber and said centrally arranged chamber, said valve hole of said wall of said centrally arranged chamber and said through-hole being arranged adjacent to said capacity control valve to thereby cooperate with said capacity control valve for controlling the cross-sectional area of said suction passageway means.

4. A variable capacity single headed piston type refrigerant compressor according to claim 3, wherein said centrally arranged chamber of said suction passageway means receives therein said capacity control valve.

5. A variable capacity single headed piston type refrigerant compressor according to claim 1, wherein said capacity control valve comprises:

a bellows element for defining a pressure sensitive chamber fluidly communicating with said suction passageway means and a reference pressure chamber isolated from said pressure sensitive chamber and establishing therein a reference pressure, said bellows element being movable to a position reducing the cross section area of said part of said suction passageway means; and a spring element arranged within said reference pressure chamber to constantly urge said bellows element toward said pressure sensitive chamber.

6. A variable capacity single headed piston type refrigerant compressor according to claim 5, wherein said reference pressure chamber comprises an atmospheric pressure chamber.

7. A variable capacity single headed piston type refrigerant compressor according to claim 5, wherein said pressure sensitive chamber of said capacity control valve comprises a part of said suction passageway means in which a pressure substantially equal to a pressure prevailing in said crank chamber prevails.

8. A variable capacity single headed piston type refrigerant compressor according to claim 5, wherein said spring element is arranged to be adjustable in its spring force, said spring force cooperating with said reference pressure so as to confront a pressure prevailing in said pressure sensitive chamber.

9. A variable capacity single headed piston type refrigerant compressor according to claim 1, further comprising a muffling chamber formed in a part of said cylinder block and a part of said front housing, said muffling chamber being fluidly communicated with said discharge chamber formed in said rear chamber for damping pulsations in the pressure of the compressed refrigerant gas.

10. A variable capacity single headed piston type refrigerant compressor according to claim 9, wherein said muffling chamber is provided with a delivery port through which the compressed refrigerant gas, after the pulsations in the discharge pressure are damped, is delivered toward an external refrigerating system.

11. A variable capacity single headed piston type compressor of claim 1 further comprising a means for constantly urging the swash plate in a direction to reduce the angle of inclination of the swash plate with respect to a plane perpendicular to the axis of rotation of the drive shaft.

* * * * *